US009402125B2

(12) United States Patent
Davie et al.

(10) Patent No.: US 9,402,125 B2
(45) Date of Patent: Jul. 26, 2016

(54) HEADSET HAVING A ROTATING AND EXTENSIBLE EAR BUD ASSEMBLY

(71) Applicant: Google Technology Holdings LLC, Mountain View, CA (US)

(72) Inventors: Sean N. Davie, Lawrenceville, GA (US); Mark R. Brandau, Johns Creek, GA (US); William C. Phelps, III, Lawrenceville, GA (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 14/465,246

(22) Filed: Aug. 21, 2014

(65) Prior Publication Data

US 2015/0189419 A1 Jul. 2, 2015

Related U.S. Application Data

(60) Provisional application No. 61/921,709, filed on Dec. 30, 2013.

(51) Int. Cl.
*H04R 25/00* (2006.01)
*H04R 1/10* (2006.01)

(52) U.S. Cl.
CPC ..... *H04R 1/105* (2013.01); *H04R 1/1041* (2013.01); *H04R 1/1066* (2013.01); *H04R 2225/63* (2013.01); *H04R 2430/01* (2013.01)

(58) Field of Classification Search
USPC ..... 381/381, 330
See application file for complete search history.

(56) References Cited

U.S. PATENT DOCUMENTS 6,427,018 B1 * 7/2002 Keliiliki ..... H04R 1/1066 381/370
8,320,603 B2 * 11/2012 Bass ..... H04R 1/10 381/330
2012/0052924 A1 3/2012 Cybart et al.

FOREIGN PATENT DOCUMENTS

WO 03083363 A1 10/2003
WO 2008145127 A1 12/2008

OTHER PUBLICATIONS

"Flashers and Turn Signal Switches", Grote Industries Product Catalog, 2005, 2 pages.
Smith, "GorillaPod guys slide out boom-equipped Bluetooth headset", The Register (http://www.theregister.co.uk/2008/01/07/ces_joby_readies_zivio/), Jan. 7, 2008, 4 pages.
"Jabra's Motion is large and in charge", CNet Review, YouTube (http://www.youtube.com/watch?v=YChufrYswDc), May 31, 2013, 2 pages.

* cited by examiner

*Primary Examiner* — Amir Etesam

(57) ABSTRACT

A headset includes an ear hook assembly (102) and an ear bud assembly (110). The ear hook assembly includes a hook portion (104) that is configured to slip over a user's ear, and a rotatable arm portion (106) that is configured to rotate around an axis. Rotation of the rotatable arm portion around the axis causes a cam action to actuate a switch to power on and off the headset. The ear bud assembly includes a speaker to play audio, and optionally includes a microphone to receive verbal inputs. The ear bud assembly is coupled to the ear hook assembly so that the ear bud assembly rotates with the rotatable arm portion, and also slides vertically along the axis around which the rotatable arm portion rotates.

15 Claims, 14 Drawing Sheets

FIG. 2
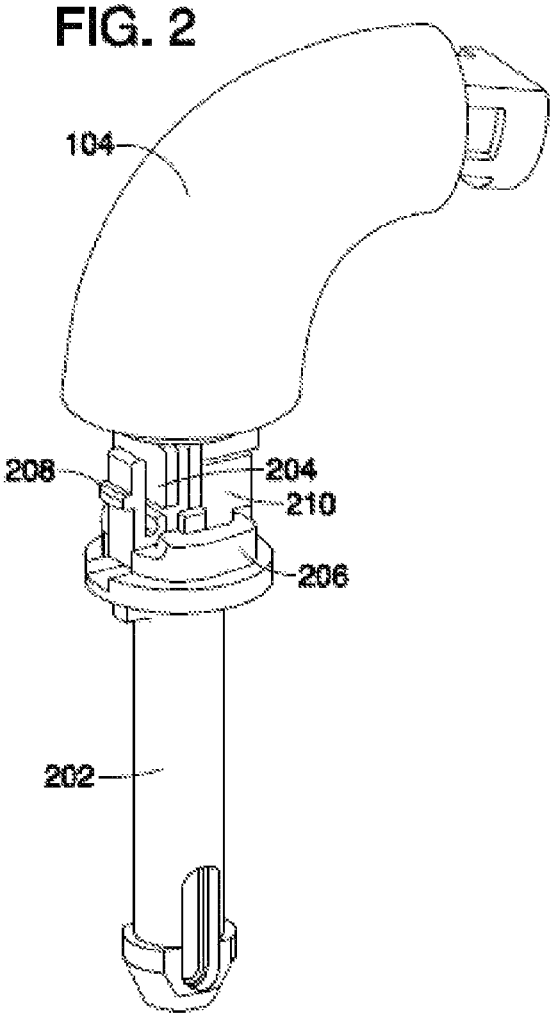
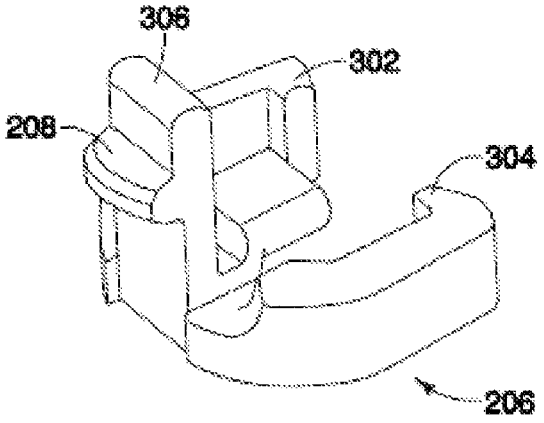
FIG. 3

HEADSET HAVING A ROTATING AND EXTENSIBLE EAR BUD ASSEMBLY

RELATED APPLICATIONS

This application claims the benefit of U.S. Provisional Application Ser. No. 61/921,709 filed Dec. 30, 2013, the entire contents of which are hereby incorporated herein by reference in their entirety.

BACKGROUND

As computing technology has advanced and computing devices have become increasingly commonplace, it has become desirable for users to interact with their computing devices in various different manners. One way in which users sometimes desire to interact with computing devices is using a headset that allows playback of audio data received from the computing device. However, problems exist with current headsets that are available to users. One such problem is that it can be difficult to provide a comfortable fitting headset with reliable power on/power off functionality. The difficulty with providing such a headset can lead to user frustration and dissatisfaction with headsets.

BRIEF DESCRIPTION OF THE DRAWINGS

Embodiments of a headset having a rotating and extensible ear bud assembly are described with reference to the following drawings. The same numbers are used throughout the drawings to reference like features and components:

FIG. 2 illustrates an example in additional detail for part of a rotatable arm portion of a headset in accordance with one or more embodiments;

FIG. 3 illustrates an actuation beam of a headset in additional detail in accordance with one or more embodiments;

DETAILED DESCRIPTION

A headset having a rotating and extensible ear bud assembly is discussed herein. The headset includes an ear hook assembly and an ear bud assembly. The ear hook assembly includes a hook portion that is configured to slip over a user's ear, and a rotatable arm portion that is configured to rotate around an axis. Rotation of the rotatable arm portion around the axis causes a cam action to actuate a switch to power on and off the headset. The headset is powered off when the rotatable arm is in certain positions, and the rotatable arm can be rotated plus or minus a particular amount (e.g., 100 degrees) from a powered off position to actuate the switch and power on the headset. The ear bud assembly includes a speaker to play audio, and optionally includes a microphone to receive verbal inputs. The ear bud assembly is coupled to the ear hook assembly so that the ear bud assembly rotates with the rotatable arm portion, and also slides vertically along the axis around which the rotatable arm portion rotates.

Figure 1:
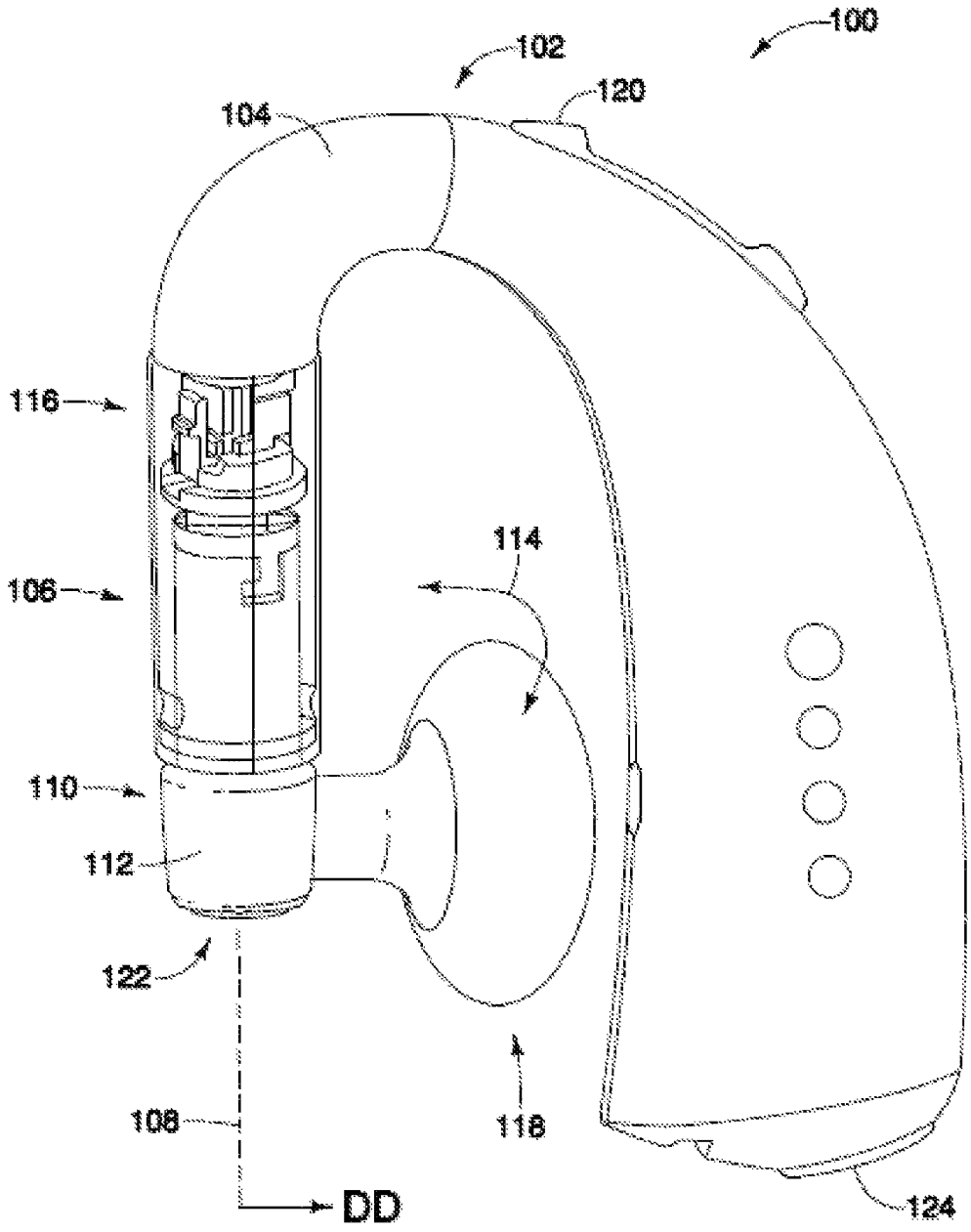
FIG. 1 illustrates an example headset having a rotating and extensible ear bud assembly in accordance with one or more embodiments.

FIG. 1 illustrates an example headset 100 having a rotating and extensible ear bud assembly in accordance with one or more embodiments. The headset 100 includes an ear hook assembly 102 having a hook portion 104 and a rotatable arm portion 106. The hook portion 104 is curved and configured to slip over a user's ear, allowing the headset to be worn by the user (the hook portion 104 resting on the user's ear and the remainder of the ear hook assembly 102 being situated behind the user's ear). The rotatable arm portion 106 is configured to rotate about an axis 108. In one or more embodiments, the ear hook assembly 102 is made of rubber, plastic, or similar material that is expected to be comfortable for users when the headset 100 is worn.

The headset 100 also includes an ear bud assembly 110. The ear bud assembly 110 is configured to rotate about the axis 108 along with the rotatable arm portion 106, and includes an ear bud arm 112 that is configured to rotate along with the rotatable arm portion 106 around or about the axis 108, illustrated as rotation 114. Rotation 114 of the ear bud assembly 110 and rotatable arm portion 106 around or about the axis 108 actuates or de-actuates a power on/power off mechanism 116, toggling the headset between being powered on (the headset 100 being in a powered on state) and being powered off (the headset 100 being in a powered off state). Thus, as the ear bud assembly 110 and the rotatable arm portion 106 are rotated around or about the axis 108, at some locations (one set of locations) in the rotation 114 the headset 100 is powered on, and at other locations (another set of locations) in the rotation 114 the headset 100 is powered off. At times when the headset 100 is powered on, the headset is operable to play back audio, receive verbal inputs, and/or perform other operations. At times when then headset 100 is powered off, the headset is not operable to play back audio, receive verbal inputs, and/or perform other operations.

The ear bud assembly 110 also includes a speaker 118 via which audio can be played back by the headset 100. In one or more embodiments, the power on/power off mechanism 116 is configured so that the speaker 118 is pointed towards the ear canal (or within a threshold amount of being towards the ear canal) of a user when the headset 100 is worn by the user and powered on, and so that the speaker 118 is pointed substantially (within a threshold amount of being) perpendicular to the ear canal of the user if the headset 100 were to be worn by the user and powered off.

A volume control 120 is optionally included on the headset 100 to control the volume level of the audio played back at the speaker 118, allowing the volume level to be increased or decreased. The ear bud assembly 110 also optionally includes a microphone 122 via which verbal inputs (e.g., commands, voice data, etc.) can be input by a user of the headset 100. A call activation/deactivation button 124 is also optionally included in the ear hook assembly 102, allowing telephone calls to be activated and/or deactivated.

Various different control circuitry, wiring, and so forth (not shown in FIG. 1) can be included in the headset 100. It should be noted that the particular circuitry and/or wiring included in the headset 100 can vary by implementation and based on the use for which the headset 100 is designed. For example, a headset 100 designed for use with a cellular or other wireless phone can include circuitry to transmit verbal inputs received via the microphone 122 to a wireless phone, and to receive audio to be played back at the speaker 118 from the wireless phone. The headset 100 is also optionally configured to operate wirelessly, receiving audio data from a wireless phone or other computing device. In such situations, the headset 100 also includes a battery, a battery port and/or contacts to allow the battery to be charged from an external device, and optionally battery charging circuitry.

The headset 100 can be designed to be operable with a variety of different devices. For example, the headset 100 can be designed to be operable with a cellular or other wireless phone, a computing device, an audio and/or video playback device, a recording device, and so forth. The headset 100 can also be designed to be operable with various wearable devices, such as watches, eyeglasses, and so forth. The headset 100 can also optionally include the functionality of one or more of these devices. For example, the headset 100 can be a cellular or other wireless phone, an audio and/or video playback device, and so forth.

It should also be noted that the locations of various components in the headset 100 can be changed. For example, the location of the volume control 120, the call activation/deactivation button 124, and/or the microphone 122 can be changed. The various components can be changed to different parts of the same assembly or to a different assembly. For example, the microphone 122 can be included as part of the ear hook assembly 102 rather than the ear bud assembly 110. By way of another example, the volume control 120 can be included as part of the ear bud assembly 110 rather than the ear hook assembly 102.

FIG. 2 illustrates an example in additional detail for part of the rotatable arm portion 106 of FIG. 1 in accordance with one or more embodiments. Internal to the rotatable arm portion is an ear stem shaft 202, a tactile switch 204, an actuation beam 206, and a protrusion 208. Part of the hook portion 104 is illustrated in FIG. 2, and the ear stem shaft 202 is affixed to the hook portion 104. The ear stem shaft 202 does not rotate when the rotatable arm portion rotates (e.g., is stationary when the rotatable arm portion rotates). The ear stem shaft 202 can be hollow, allowing circuitry or wiring for the headset 100 to be maintained or included within the ear stem shaft 202. In one or more embodiments, the ear stem shaft 202 is made of a rigid material, such as plastic, although other materials can alternatively be used.

FIG. 3 illustrates the actuation beam 206 in additional detail in accordance with one or more embodiments. The actuation beam 206 snaps onto the ear stem shaft 202, being held in place by extensions 302 and 304. Referring to FIGS. 2 and 3, the extensions 302 and 304 snap around corresponding extensions of the ear stem shaft 202, applying at least a threshold amount of pressure to the extensions of the ear stem shaft 202 to keep the actuation beam 206 secured to the ear stem shaft 202. An extension 210 of the ear stem shaft 202 is illustrated in FIG. 2, and the extension 304 of the actuation beam 206 snaps around the extension 210 of the ear stem shaft 202. The extension 302 of the actuation beam 206 snaps around an analogous extension (not shown) of the ear stem shaft 202.

The actuation beam 206 includes a protrusion 208. As discussed in more detail below, at certain times pressure is applied to the protrusion 208, causing an arm 306 of the actuation beam 206 to press against a contact portion of the switch 204 and actuate the switch 204. The contact portion of the switch 204 is a surface of the switch 204 facing the side of the arm 306 opposite the protrusion 208. The switch 204 is a tactile (tact) switch, actuation of which results in the headset 100 being powered on. When pressure is applied to the switch 204, the headset 100 is powered on and operates to play back audio and/or receive verbal inputs. When pressure is not applied to the switch 204, the headset 100 is powered off and does not play back audio and/or receive verbal inputs.

In one or more embodiments, the actuation beam 206 is made of a rigid material, such as plastic, although other materials can alternatively be used. Although the actuation beam 206 is made of a rigid material, the actuation beam 206 allows some flexibility so that the actuation beam 206 can be attached to the ear stem shaft 202, and so that the arm 306 can move some (and actuate the switch 204) in response to pressure applied to the protrusion 208.

The actuation beam 206 is a separate component that attaches to the ear stem shaft 202. Having the actuation beam 206 be a separate component allows more freedom for the actuation beam 206 to translate pressure applied to the protrusion 208 linearly to the switch 204. The actuation beam 206 being a separate component also allows the actuation beam 206 to shift, rock, bend, and so forth, and still actuate the switch 204 when pressure is applied to the protrusion 208.

Figure 4:
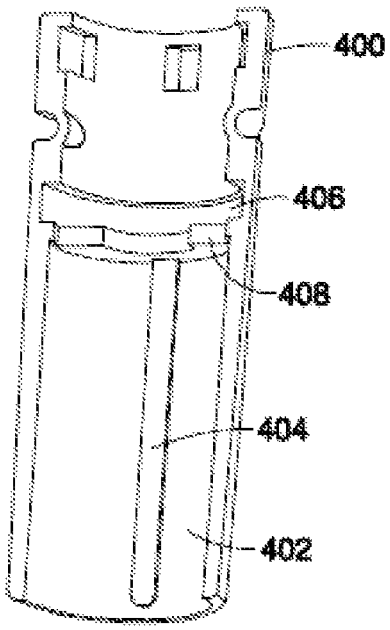
FIGS. 4 and 5 illustrate an example collar portion of a headset in accordance with one or more embodiments.
Figure 5:
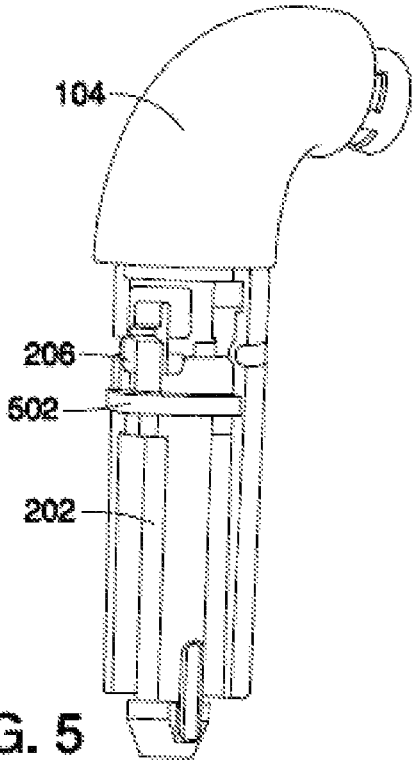

The rotatable arm portion includes a collar that surrounds the ear stem shaft 202 and the actuation beam 206. The collar is made up of two different portions. FIGS. 4 and 5 illustrate an example collar portion 400 in accordance with one or more embodiments. The collar portion 400 includes an inner surface 402 that faces the ear stem shaft 202. The collar portion 400 includes a rib 404, a groove 406, and a support bar 408. The rib 404 protrudes from the inner surface 402, and aligns with a groove of an ear bud assembly as discussed in more detail below. The groove 406 is a recession in the inner surface 402, providing a space that aligns with a flange 502 of the ear stem shaft 202. The flange 502 also rests on the support bar 408. As the rotatable arm portion 106 rotates about the axis 108 of FIG. 1, the collar portion 400 rotates around the ear stem shaft 202 and the actuation beam 206.

Figure 6:
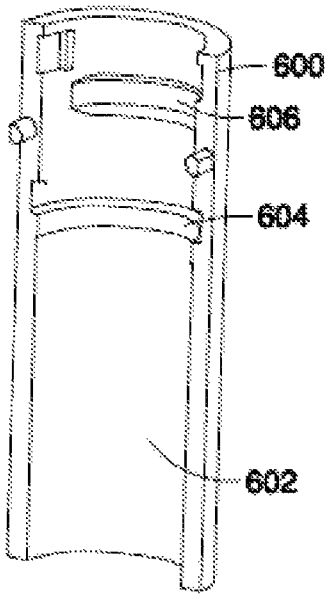
FIG. 6 illustrates another example collar portion of a headset in accordance with one or more embodiments.

FIG. 6 illustrates an example collar portion 600 in accordance with one or more embodiments. The collar portion 600 includes an inner surface 602 that faces the ear stem shaft 202. The collar portion 600 also includes a support bar 604 and a cam surface 606 that is a recession in the inner surface 602. The flange 502 of the ear stem shaft 202 rests on the support bar 604.

The headset 100 uses a cam action to actuate the switch 204, the cam action being provided by the protrusion 208 of the actuation beam 206 and the cam surface 606. As the rotatable arm portion 106 rotates about the axis 108 of FIG. 1, the collar portion 600 rotates around the ear stem shaft 202 and the actuation beam 206. At some locations during this rotation the cam surface 606 aligns with the protrusion 208 of the actuation beam 206, resulting in the arm 306 of the actuation beam 206 not pressing against the contact portion of the switch 204, and thus the headset 100 being powered off. At other locations during this rotation, the cam surface 606 does not align with the protrusion 208, resulting in the arm 306 of the actuation beam 206 pressing against the contact portion of the switch 204, and thus the headset 100 being powered on.

Figure 7:
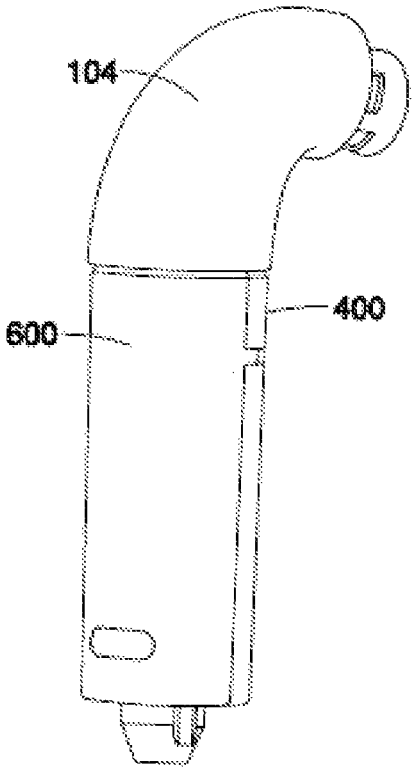
FIG. 7 illustrates two collar portions of a headset together in accordance with one or more embodiments.

The collar portion 400 of FIG. 4 and the collar portion 600 of FIG. 6 together form the collar that surrounds the ear stem shaft 202 and the actuation beam 206. FIG. 7 illustrates the two collar portions 400 and 600 together, surrounding the ear stem shaft 202 and the actuation beam 206. Each of the two collar portions 400 and 600 is made of a rigid material, such as plastic, although other materials can alternatively be used. The two collar portions 400 and 600 can optionally be bonded to one another using various techniques, such as using glue, ultrasonic bonding, and so forth. Alternatively, with the use of a sleeve encapsulating the collar as discussed in more detail below, no such bonding need be performed.

Figure 8:
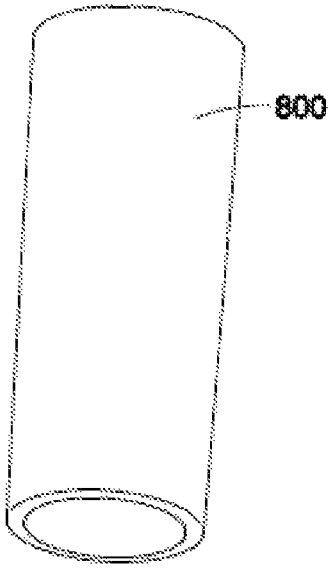
FIGS. 8 and 9 illustrate an example sleeve that encapsulates the collar of a headset in accordance with one or more embodiments.
Figure 9:
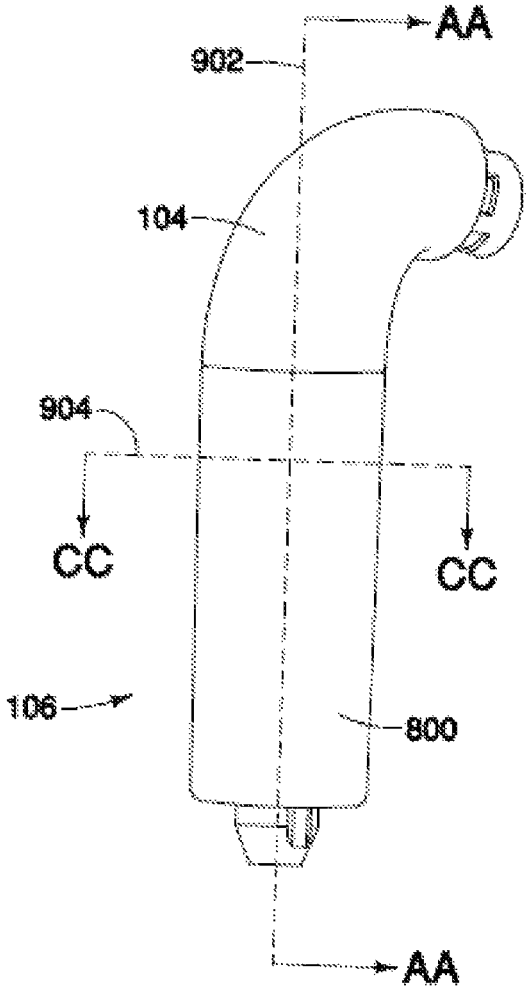

FIGS. 8 and 9 illustrate an example sleeve 800 that encapsulates the collar in accordance with one or more embodiments. The sleeve 800 encapsulates the collar portions 400 of FIGS. 4 and 600 of FIG. 6, and can optionally be bonded to the collar portions 400 and 600 using various techniques (e.g., using glue). In one or more embodiments, the sleeve 800 is made of metal (e.g., stainless steel) to provide rigidity and strength to the rotatable arm portion 106. The use of the sleeve 800 can result in tighter assembly tolerances, reducing false actuations of the switch 204 (the switch 204 being actuated even though the rotatable arm portion 106 was not rotated to a powered on position). Alternatively, the sleeve 800 can be made of other materials, such as various plastics.

As the rotatable arm portion 106 rotates about the axis 108 of FIG. 1, the sleeve 800 rotates along with the collar around the ear stem shaft 202 and the actuation beam 206. In one or more embodiments, the sleeve 800 is bonded to or otherwise configured to rotate along with the collar portions 400 and 600, so as the sleeve 800 rotates around the axis 800 so do the collar portions 400 and 600. A user can apply torque to the ear bud assembly 110 of FIG. 1 to cause the rotatable arm portion to rotate. In one or more embodiments, the user can apply torque to the sleeve 800 in a direction tangential to the surface of the sleeve 800 and perpendicular to (or within a threshold amount of being perpendicular to) the axis 108 of FIG. 1.

It should be noted that although the rotatable arm portion 106 is illustrated as being approximately cylindrical in shape, the rotatable arm portion 106 can take other forms. For example, the rotatable arm portion 106 can be a triangular prism shape, a rectangular prism shape, and so forth.

Figure 10:
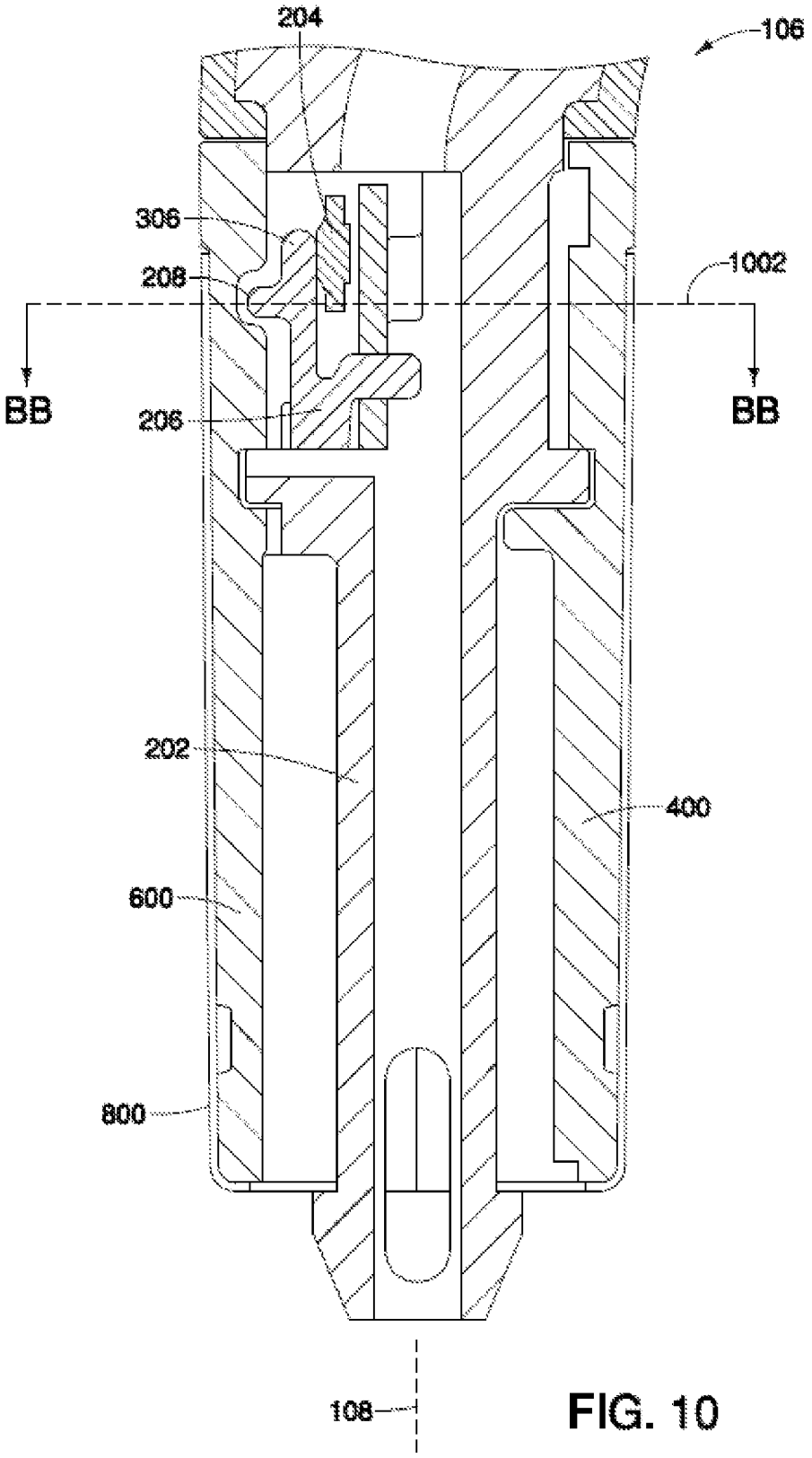
FIG. 10 illustrates a cross section view of a rotatable arm portion of a headset in accordance with one or more embodiments.

FIG. 10 illustrates a cross section view of a rotatable arm portion 106 in accordance with one or more embodiments. FIG. 10 as illustrated is a cross section view of the rotatable arm portion 106 of FIG. 9 along the line 902 in the direction indicated as AA. As illustrated in FIG. 10, the collar includes a collar made up of collar portion 400 and collar portion 600. The collar surrounds the ear stem shaft 202 and the actuation beam 206, and the sleeve 800 encapsulates the collar. The protrusion 208 is illustrated as aligning with the cam surface 606 of the collar portion 600. Accordingly, arm 306 is not applying pressure against the contact portion of the switch 204, and the headset 100 is powered off.

Figure 11:
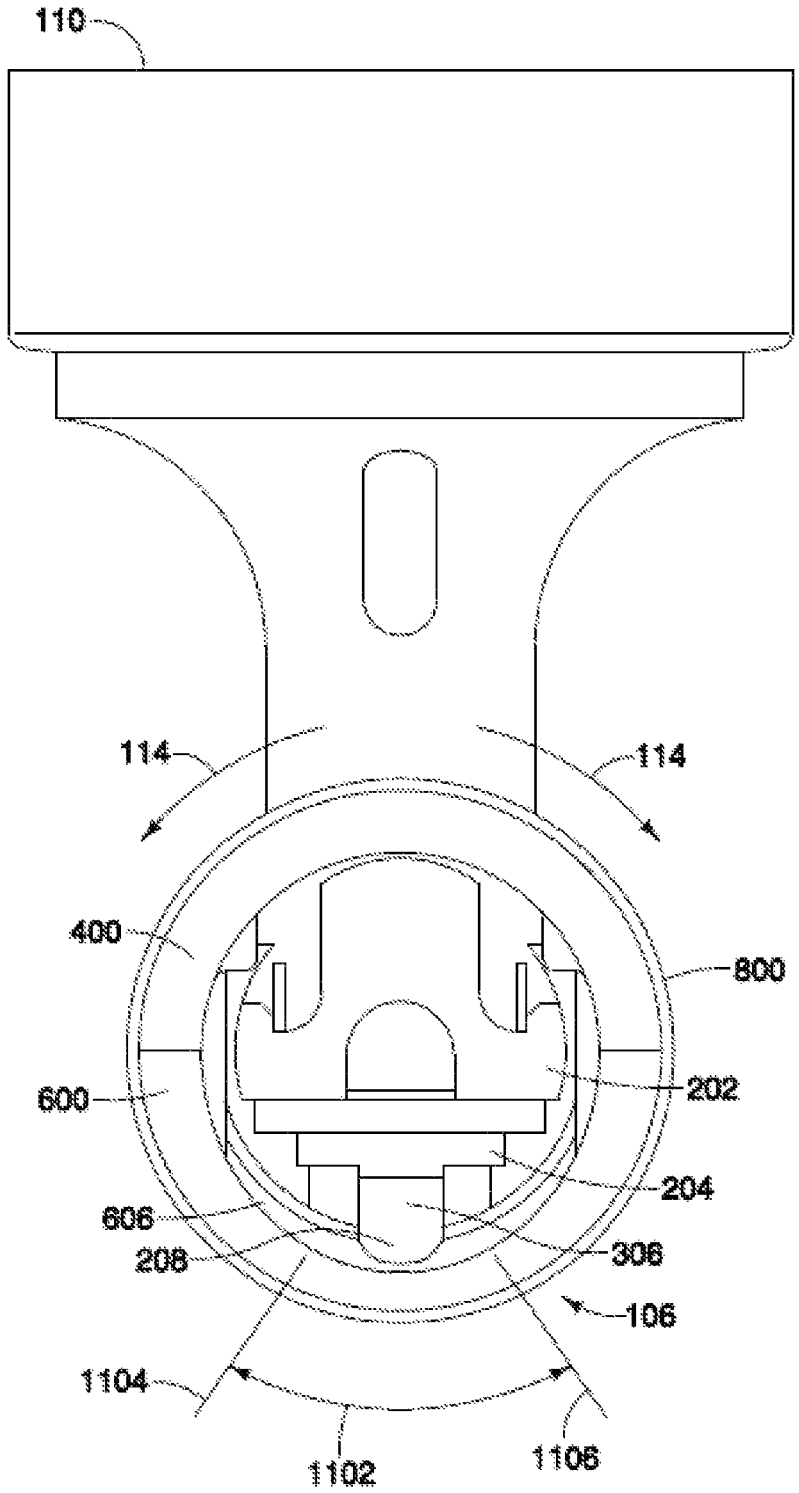
FIG. 11 illustrates another cross section view of a rotatable arm portion of a headset in accordance with one or more embodiments.

FIG. 11 illustrates a cross section view of a rotatable arm portion 106 in accordance with one or more embodiments. FIG. 11 as illustrated is a cross section view of the rotatable arm portion 106 of FIG. 10 along the line 1002 in the direction indicated as BB. As illustrated in FIG. 11, the collar includes a collar made up of collar portion 400 and collar portion 600. The collar surrounds the ear stem shaft 202, and the sleeve 800 encapsulates the collar. The protrusion 208 is illustrated as aligning with the cam surface 606 of the collar portion 600. Accordingly, arm 306 is not applying pressure against the contact portion of the switch 204, and the headset 100 is powered off.

The rotatable arm portion 106 rotates, as illustrated by rotation 114. As the rotatable arm portion 106 rotates, the ear bud assembly 110 rotates with the rotatable arm portion 106. The cam surface 606 is a recessed area that is graduated, so that as the rotatable arm portion 106 is rotated from its position illustrated in FIG. 11, pressure is gradually applied to the protrusion 208. As the rotation 114 continues, at some point or location the pressure applied to the protrusion 208 is sufficient to cause the arm 306 to actuate the switch 204.

Thus, there are multiple locations through the range of motion (e.g., plus or minus 100 degrees from a particular position of the rotatable arm portion 106, or within a threshold amount of plus or minus 100 degrees from the particular position) where the switch 204 is actuated and the headset is powered on, and multiple locations where the switch is not actuated (is de-actuated) and the headset is powered off. For example, the range of locations 1102 between lines 1104 and 1106 as the rotatable arm portion 106 is rotated about the axis 108 are locations where the switch is not actuated, and other locations as the rotatable arm portion 106 is rotated about the axis 108 are locations where the switch is actuated. The rotatable arm portion can rotate, for example, plus or minus 100 degrees (or within a threshold amount of plus or minus 100 degrees) of a particular position that is a midway location (or within a threshold amount of being a midway location) of the range of locations 1102 between lines 1104 and 1106.

Figure 12:
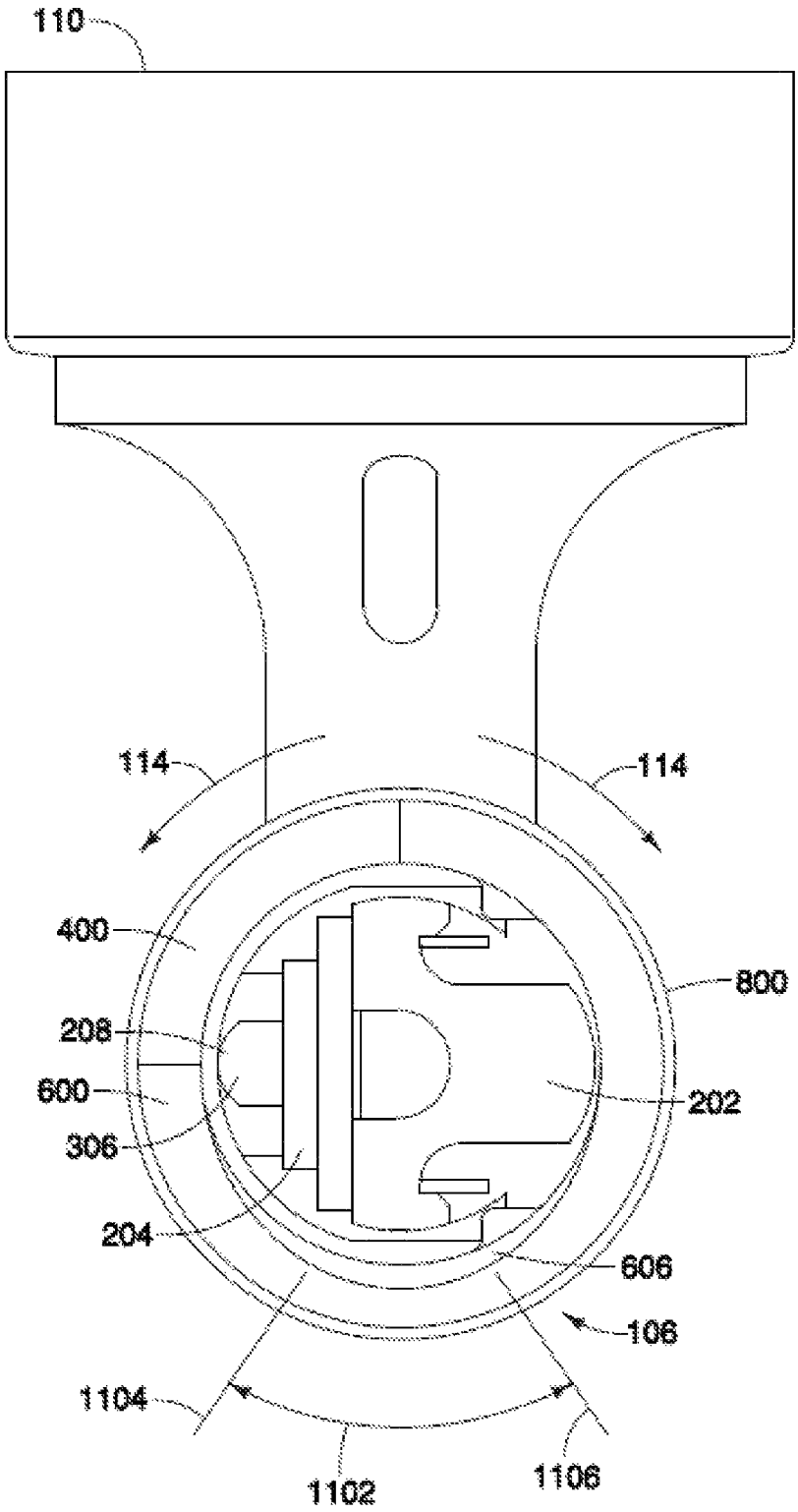
FIG. 12 illustrates another cross section view of a rotatable arm portion of a headset in accordance with one or more embodiments.

FIG. 12 illustrates a cross section view of a rotatable arm portion 106 in accordance with one or more embodiments. FIG. 12 as illustrated is a cross section view of the rotatable arm portion 106 of FIG. 9 along the line 904 in the direction indicated as CC. As illustrated in FIG. 12, the collar includes a collar made up of collar portion 400 and collar portion 600. The collar surrounds the ear stem shaft 202, and the sleeve 800 encapsulates the collar. FIG. 12 is similar to FIG. 11, except that the rotatable arm portion 106 in FIG. 12 is rotated approximately 90 degrees from that illustrated in FIG. 11. Thus, the protrusion 208 is illustrated as no longer aligning with the cam surface 606 of the collar portion 600. Accordingly, arm 306 is applying pressure against the contact portion of the switch 204, and the headset 100 is powered on.

The rotatable arm portion 106 rotates, as illustrated by rotation 114. As the rotatable arm portion 106 rotates, the ear bud assembly 110 rotates with the rotatable arm portion 106.

Thus, as can be seen from the FIGs. above, the cam surface 606 rotates in a plane that is substantially (e.g., within a threshold number of degrees of being) perpendicular to the axis about which the rotatable arm portion 106 rotates (axis 108). The cam action provided by the cam surface 606 and the protrusion 208, which provides the switching action to toggle between the headset being powered on and powered off, thus operates in that plane that is substantially perpendicular to the axis 108. The contact portion of the switch 204 is in a plane substantially (e.g., within a threshold number of degrees of being) parallel to the axis 108. Thus, the contact portion of the switch 204 is thus also substantially (e.g., within a threshold number of degrees of being) perpendicular to the cam action.

Figure 13:
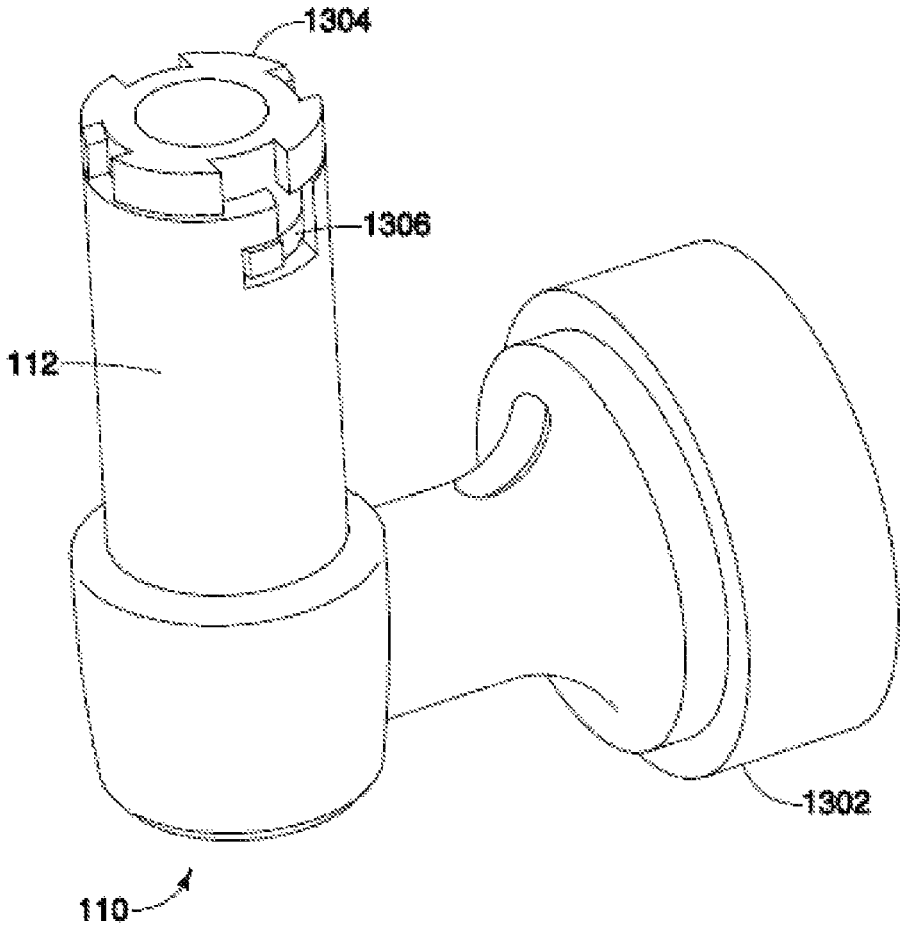
FIG. 13 illustrates an example ear bud assembly of a headset in accordance with one or more embodiments.

FIG. 13 illustrates an example ear bud assembly 110 in accordance with one or more embodiments. The ear bud assembly 110 includes an ear bud arm 112 that is configured to rotate along with the rotatable arm portion 106 around or about the axis 108 of FIG. 1. The ear bud arm 112 is also referred to as having the same axis as the rotatable arm portion 106. The ear bud arm 112 can thus also be referred to as being co-axial with the rotatable arm portion 106, including being co-axial with the sleeve 800 and the collar (made up of collar portions 400 and 600).

The ear bud assembly 110 includes a speaker housing 1302 in which the speaker 118 can reside. The speaker housing 1302 is approximately perpendicular to (e.g., within a threshold amount of being perpendicular to) the ear bud arm 112.

The ear bud assembly 110 is movably coupled to the ear hook assembly 102 so that the ear bud assembly 110 rotates as the rotatable arm portion 106 rotates. The ear bud arm 112 and the speaker housing 1302 are a single piece or alternatively multiple pieces bonded together using any of a variety of public and/or proprietary techniques. Thus, as the ear bud arm 112 rotates, the speaker housing 1302 rotates as well.

The movable coupling of the ear bud assembly 110 to the ear hook assembly 102 also allows the ear bud assembly 110 to slide vertically along the axis 108. This sliding of the ear bud assembly 110 along the axis 108 is independent of the powering on and powering off performed by rotating the rotatable arm portion 106 about the axis 108. In one or more embodiments, the ear bud assembly 110 includes a bushing 1304 and an O-ring 1306 to facilitate vertical movement of the ear bud assembly 110 along the axis 108, as discussed in more detail below.

Figure 14:
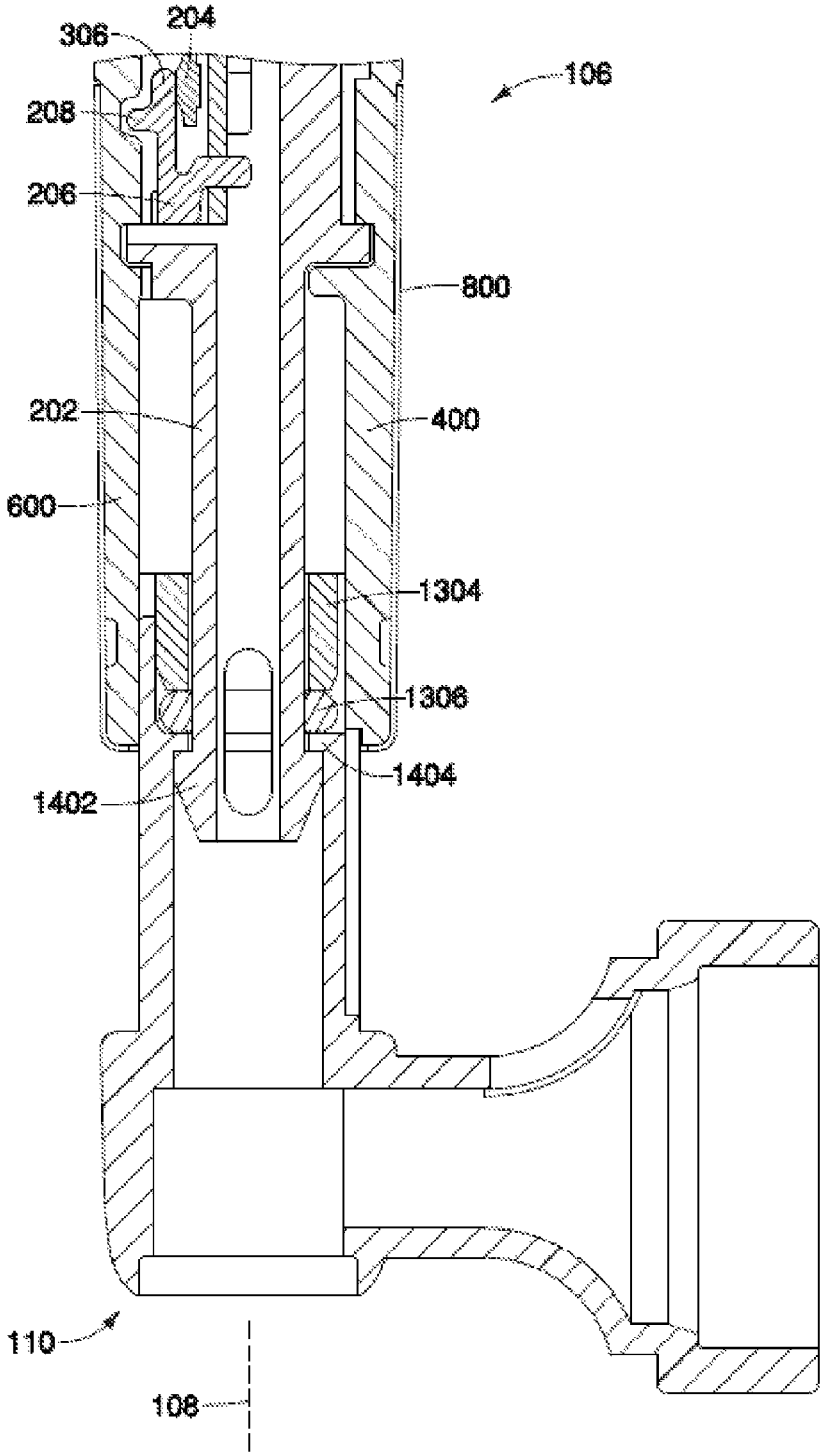
FIG. 14 illustrates a cross section view of a rotatable arm portion and an ear bud assembly of a headset in accordance with one or more embodiments.

FIG. 14 illustrates a cross section view of a rotatable arm portion 106 and ear bud assembly 110 in accordance with one or more embodiments. FIG. 14 as illustrated is a cross section view of the rotatable arm portion 106 and ear bud assembly 110 of FIG. 1 along the axis line 108 in the direction indicated as DD, although FIG. 14 illustrates the ear bud assembly 110 in a fully extended position. The cross section view of the rotatable arm portion 106 is the same as the cross section view of the rotatable arm portion 106 in FIG. 10. As illustrated in FIG. 14, the collar includes a collar made up of collar portion 400 and collar portion 600. The collar surrounds the ear stem shaft 202 and the actuation beam 206, and the sleeve 800 encapsulates the collar. The protrusion 208 is illustrated as aligning with the cam surface 606 of the collar portion 600. Accordingly, arm 306 is not applying pressure against the contact portion of the switch 204, and the headset 100 is powered off.

The ear bud assembly 110 is movably coupled to the rotatable arm portion 106, being inserted into the end of the rotatable arm portion 106 as illustrated. The ear bud assembly 110 slides vertically along the axis 108, and is illustrated in FIG. 14 in a fully extended position. The ear stem shaft 202 includes a stop 1402 that aligns with a stop 1404 on the ear bud assembly, preventing the ear bud assembly 110 from de-coupling from the rotatable arm portion 106. The bushing 1304 guides the ear bud assembly 110 along the ear stem shaft 202, allowing the ear bud assembly 110 to slide smoothly along axis 108.

The O-ring 1306 allows the ear bud assembly 110 to remain in a location once movement of the ear bud assembly 110 stops. The ear bud assembly 110 can be slid vertically along the axis 108 by applying pressure along the axis, and can be stopped at various different locations while sliding. The O-ring 1306 applies pressure to the ear stem shaft 202 to allow the ear bud assembly 110 to remain in a particular location once stopped. In one or more embodiments, the O-ring 1306 is made of rubber, although other materials can alternatively be used.

Figure 15:
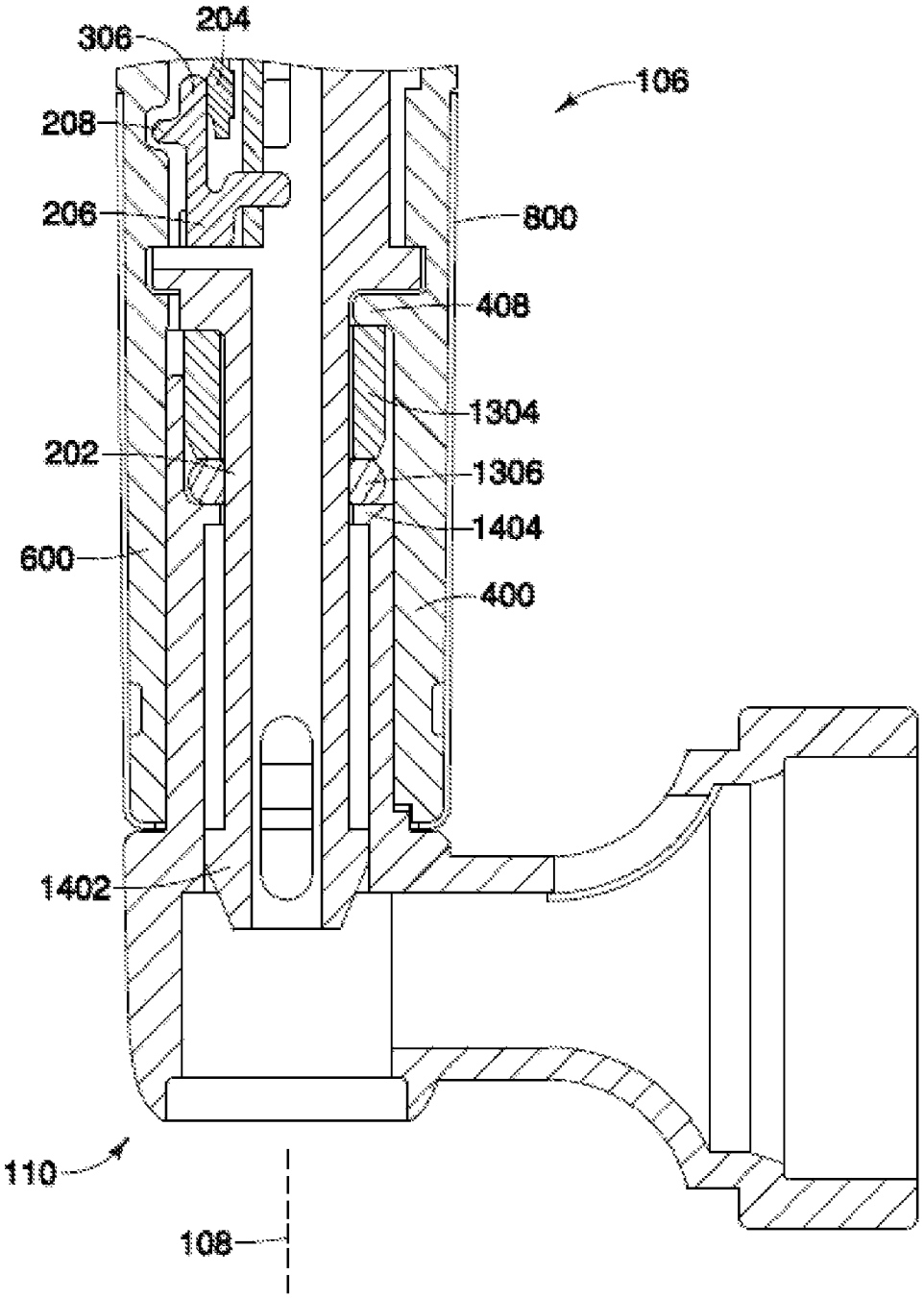
FIG. 15 illustrates another cross section view of a rotatable arm portion and an ear bud assembly of a headset in accordance with one or more embodiments.

FIG. 15 illustrates a cross section view of a rotatable arm portion 106 and ear bud assembly 110 in accordance with one or more embodiments. FIG. 15 as illustrated is a cross section view of the rotatable arm portion 106 and ear bud assembly 110 of FIG. 1 along the axis line 108 in the direction indicated as DD. FIG. 15 illustrates the same cross section view as FIG. 14, except that the ear bud assembly 110 is illustrated in a fully retracted position in FIG. 15. The support bar 408 of the collar portion 400, as well as part of the ear bud assembly 110 abutting the sleeve 800, operate as stops preventing the ear bud assembly 110 from sliding further into the rotatable arm portion 106.

Figure 16:
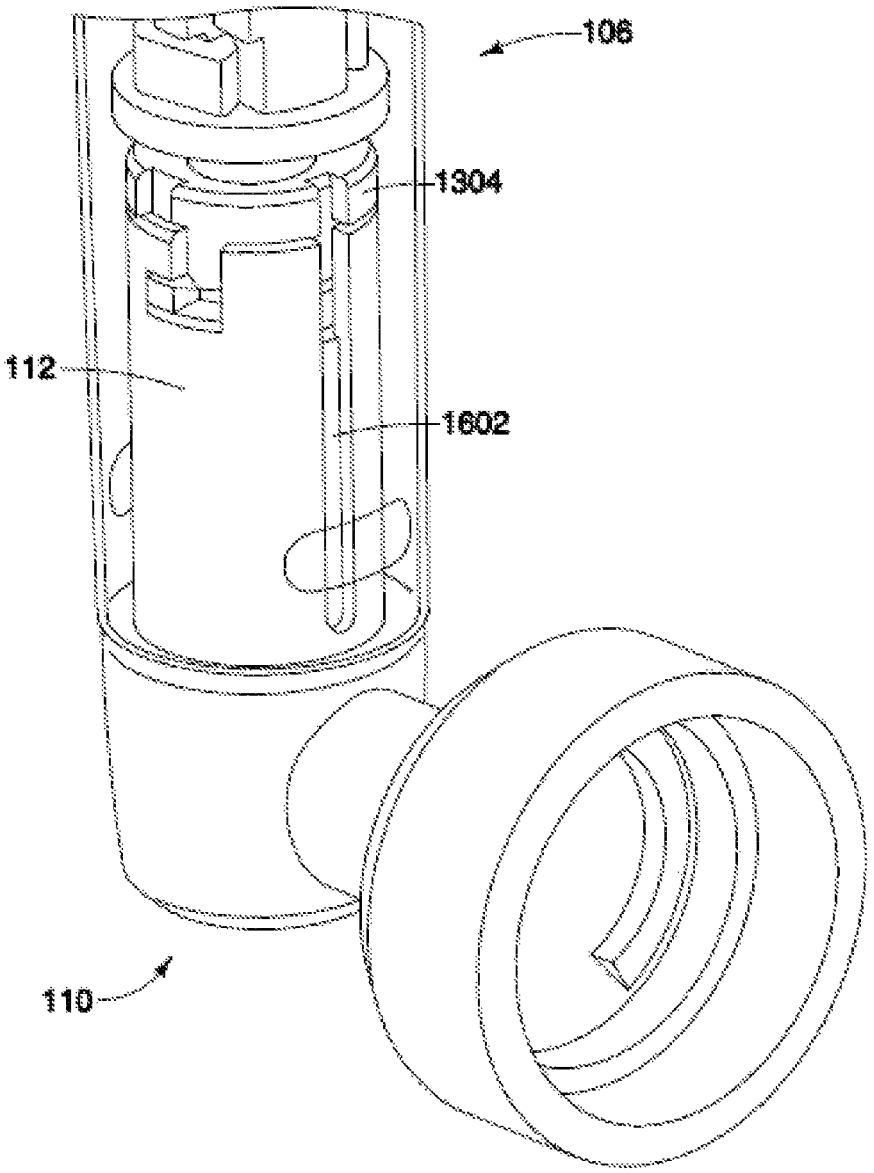
FIG. 16 illustrates a rotatable arm portion and an ear bud assembly of a headset in accordance with one or more embodiments.

FIG. 16 illustrates a rotatable arm portion 106 and ear bud assembly 110 in accordance with one or more embodiments. The ear bud arm 112 includes a groove 1602, which is a recession in the ear bud arm 112 that aligns with the rib 404 that protrudes from the collar portion 400 as illustrated in FIG. 4. The groove 1602 is substantially (e.g., within a threshold number of degrees of being) parallel to the axis 108 about which the rotatable arm portion 106 rotates. The combination of the rib 404 and the groove 1602 effectively locks the ear bud assembly 110 to the rotatable arm portion 106, allowing the ear bud assembly 110 to rotate about the axis 108 along with the rotatable arm portion 106 (and preventing the ear bud assembly 110 from rotating about the axis 108 independently of the rotatable arm portion 106). However, the rib 404 extends along the collar portion 400, and the groove 1602 extends along the ear bud arm 112, so the ear bud assembly 110 is able to slide vertically along the axis 108.

Figure 17:
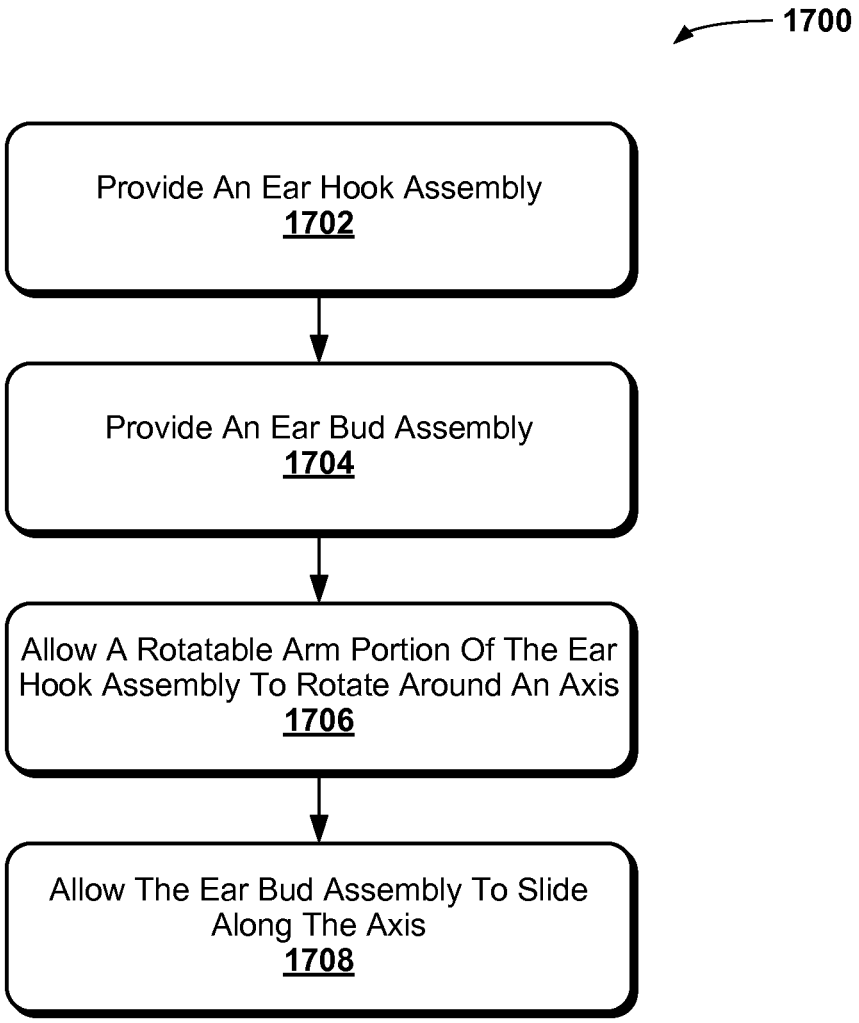
FIG. 17 is an example flowchart for providing a headset having a rotating and extensible ear bud assembly in accordance with one or more embodiments.

FIG. 17 is an example flowchart 1700 for providing a headset having a rotating and extensible ear bud assembly in accordance with one or more embodiments. FIG. 17 is shown as a set of acts and is not limited to the order shown for performing the operations of the various acts. Additionally, FIG. 17 is an example of providing a headset having a rotating and extensible ear bud assembly discussed herein; additional discussions of providing a headset having a rotating and extensible ear bud assembly are included herein with reference to different FIGs.

In process 1700, an ear hook assembly is provided (act 1702). The ear hook assembly is configured to slip over a user's ear, and can include various components such as volume control components, a call activation/deactivation button, and so forth, as discussed above.

An ear bud assembly is also provided (act 1704). The ear bud assembly includes a speaker housing with a speaker, and an ear bud arm as discussed above.

The ear hook assembly includes a rotatable arm portion, and the rotatable arm portion is allowed to rotate around an axis (act 1706). Rotation of the rotatable arm portion allows the headset to be powered on and powered off through a cam action as discussed above.

The ear bud assembly is also allowed to slide along the axis (act 1708). The ear bud assembly can slide vertically along the axis while maintaining the ability to rotate about the around the axis.

Thus, the headset discussed herein provides a comfortable and user friendly headset for a user. The user can easily rotate the ear bud assembly to power on or power off the headset. It is expected that the headset spends more time powered off than powered on, and wear and tear on the switch is reduced because pressure is applied to the switch when the headset is powered on but not when powered off. This reduction in wear and tear on the switch can extend the life of the switch and thus improve reliability of the headset. The user can also easily slide the ear bud assembly along (parallel to) the axis of rotation, allowing the user to adjust the ear bud to a location that is comfortable for the user.

Figure 18:
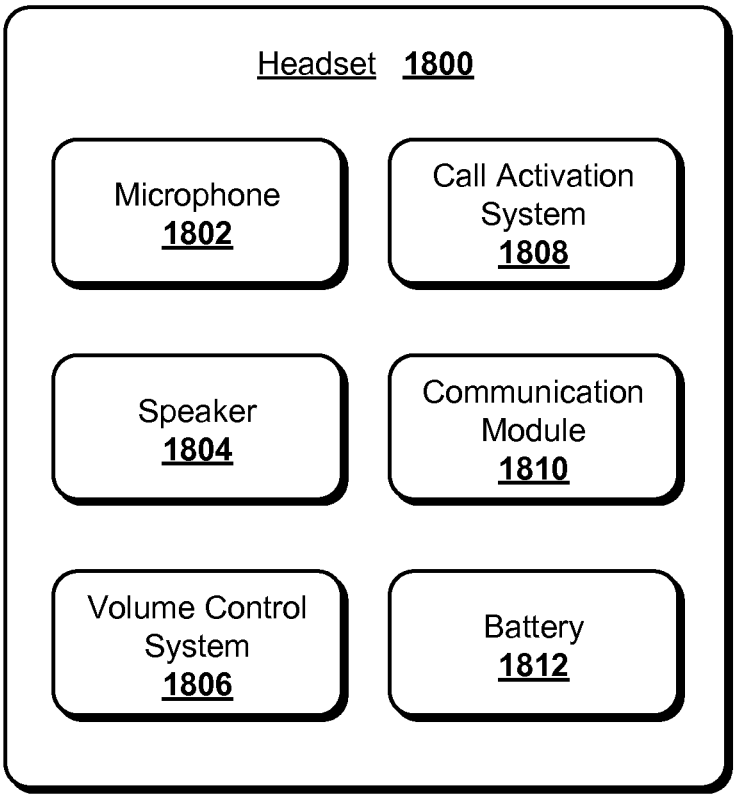
FIG. 18 illustrates various components of an example headset having a rotating and extensible ear bud assembly.

FIG. 18 illustrates various components of an example headset 1800 that can be implemented as a headset as described with reference to any of the previous FIGS. 1-17. The headset 1800 is a device that allows playback of audio data and/or verbal inputs as discussed above, and can be the headset 100 described with reference to FIG. 1.

The headset 1800 includes a microphone 1802, allowing verbal inputs to the headset 1800. The headset 1800 also includes a speaker 1804, allowing audio to be played back by the headset 1800. The headset 1800 also includes a volume control system 1806, allowing the volume of audio played back by the speaker 1804 to be increased or decreased.

The headset 1800 can also include a call activation system 1808, allowing phone calls to be activated and/or deactivated. Activation of a phone call refers to placing a phone call, such as calling a particular phone number. Deactivation of a phone call refers to terminating a phone call, such as hanging up a phone.

The headset 1800 can also include a communication module 1810. In one or more embodiments, the communication module 1810 communicates with another device, such as a cellular or other wireless phone, receiving audio data form the device for playback by the speaker 1804 and/or providing verbal input received by the microphone 1802 to the device. Alternatively, the communication module 1810 can provide cellular or other wireless phone functionality, allowing the headset 1800 to operate as a cellular or other wireless phone.

The headset 1800 can also include a battery 1812, which provides power to the various components 1802-1810 of the headset 1800. The battery 1812 can optionally be rechargeable battery, and additional charging circuitry can also be included in the headset 1800 to allow the battery 1812 to be recharged. Alternatively, rather than or in addition to the battery 1812, the headset 1800 may include a port via which power can be provided to the headset 1800 from another device.

It should be noted that the components 1802-1812 are examples of components that can be included in the headset 1800, and that other components can additionally or alternatively be included in the headset 1800. Which components are included in the headset 1800 can vary based on the intended use of the headset 1800. For example, the headset 1800 can include nonvolatile memory and a processor or other controller to manage storage and playback of audio and/or video data.

Although embodiments of a headset having a rotating and extensible ear bud assembly have been described in language specific to features and/or methods, the subject of the appended claims is not necessarily limited to the specific features or methods described. Rather, the specific features and methods are disclosed as example implementations of a headset having a rotating and extensible ear bud assembly.

The invention claimed is:

1. A device comprising:

an ear hook assembly configured to slip over a user's ear, the ear hook assembly including a hook portion and a rotatable arm portion configured to rotate around an axis; and an ear bud assembly including a speaker to play audio, the ear bud assembly being movably coupled to the ear hook assembly and configured to slide vertically along the axis wherein the rotatable arm portion including an actuation beam, a switch, and a collar, the collar rotating around the actuation beam and using a cam action to actuate the switch as the collar is rotated around the actuation beam and the collar including a cam surface that aligns with a protrusion of the actuation beam at a first set of locations as the collar is rotated around the actuation beam but that does not align with the protrusion of the actuation beam at a second set of locations as the collar is rotated around the actuation beam, the switch being actuated at the second set of locations.

2. The device as recited in claim 1, rotation of the rotatable arm portion causing the device to toggle between a power on state and a power off state.

3. The device as recited in claim 2, the rotatable arm portion being rotatable within a threshold amount of plus or minus 100 degrees from a power off position.

4. The device as recited in claim 1, the cam surface rotating in a plane as the collar is rotated around the actuation beam, and a switching action to actuate the switch being in the plane.

5. The device as recited in claim 1, the cam surface rotating in a plane as the collar is rotated around the actuation beam, the axis being perpendicular to the plane.

6. The device as recited in claim 1, the switch including a contact portion to which pressure is applied to actuate the switch, and the cam action being perpendicular to the contact portion of the switch.

7. The device as recited in claim 1, the collar being encapsulated in a sleeve that rotates with the collar.

8. The device as recited in claim 1, the rotatable arm portion including a collar that rotates around the axis and further including a sleeve that encapsulates the collar and that rotates around the axis with the collar, the ear bud assembly including an ear bud arm that is co-axial with the collar and the sleeve.

9. The device as recited in claim 8, the ear bud arm having a groove along the axis that is aligned with a rib of the collar as the ear bud assembly slides along the axis.

10. A headset comprising:

an ear hook assembly having a curved portion and a rotatable arm portion, the rotatable arm portion being rotatable around an axis; and an ear bud assembly including a speaker to play audio, the ear bud assembly being movably coupled to the rotatable arm portion and slideable along the axis wherein the rotatable arm portion including an actuation beam, a switch, and a collar, the collar rotating around the actuation beam and using a cam action to actuate the switch as the collar is rotated around the actuation beam and the collar including a cam surface that aligns with a protrusion of the actuation beam at a first set of locations as the collar is rotated around the actuation beam but that does not align with the protrusion of the actuation beam at a second set of locations as the collar is rotated around the actuation beam, the switch being actuated at the second set of locations.

11. The headset as recited in claim 10, the switch including a contact portion to which pressure is applied to actuate the switch, and the cam action being perpendicular to the contact portion of the switch.

12. The headset as recited in claim 10, the collar being encapsulated in a sleeve that rotates with the collar.

13. A headset comprising:

an ear hook assembly including a curved portion and an arm portion, the curved portion being curved to slip over an ear of a user, and the arm portion being configured to rotate about an axis; and an ear bud assembly including a speaker to play audio, the ear bud assembly being coupled to the arm portion so as to slide along the axis wherein the rotatable arm portion including an actuation beam, a switch, and a collar, the collar rotating around the actuation beam and using a cam action to actuate the switch as the collar is rotated around the actuation beam and the collar including a cam surface that aligns with a protrusion of the actuation beam at a first set of locations as the collar is rotated around the actuation beam but that does not align with the protrusion of the actuation beam at a second set of locations as the collar is rotated around the actuation beam, the switch being actuated at the second set of locations.

14. The headset as recited in claim 13, the arm portion further including a sleeve that encapsulates the collar and that rotates about the axis with the collar, the ear bud assembly including an ear bud arm that is co-axial with the collar and the sleeve.

15. The headset as recited in claim 14, the ear bud arm having a groove along the axis that is aligned with a rib of the collar as the ear bud assembly slides along the axis.

* * * * *